US007594861B2

(12) United States Patent
Gayso

(10) Patent No.: US 7,594,861 B2
(45) Date of Patent: Sep. 29, 2009

(54) DIRECT FLEX

(75) Inventor: Don W. Gayso, Memphis, TN (US)

(73) Assignee: Directflex, LLC, Memphis, TN (US)

( * ) Notice: Subject to any disclaimer, the term of this patent is extended or adjusted under 35 U.S.C. 154(b) by 0 days.

(21) Appl. No.: 11/879,556

(22) Filed: Jul. 18, 2007

(65) Prior Publication Data

US 2009/0023514 A1 Jan. 22, 2009

(51) Int. Cl.
*A63B 53/10* (2006.01)
*A63B 53/12* (2006.01)

(52) U.S. Cl. ..... 473/318

(58) Field of Classification Search ..... 473/316–323, 473/297–299

See application file for complete search history.

(56) References Cited

U.S. PATENT DOCUMENTS 1,591,363 A * 7/1926 Cowdery ..... 473/304
1,879,117 A * 9/1932 Davidson ..... 473/247
2,992,828 A * 7/1961 Stewart ..... 473/314
3,461,593 A * 8/1969 Martuch et al. ..... 43/18.5
4,105,205 A * 8/1978 Theodores et al. ..... 473/523
4,214,395 A * 7/1980 Caldwell, Jr. ..... 43/18.1 R
4,221,400 A * 9/1980 Powers ..... 280/602
5,683,308 A * 11/1997 Monette ..... 473/318
6,045,457 A * 4/2000 Soong ..... 473/318
6,113,508 A * 9/2000 Locarno et al. ..... 473/516
6,257,997 B1 * 7/2001 Doble et al. ..... 473/516
6,394,909 B1 * 5/2002 Laibangyang ..... 473/232
7,252,597 B2 * 8/2007 Li et al. ..... 473/318
2003/0148820 A1 * 8/2003 Kumamoto ..... 473/318
2004/0082402 A1 * 4/2004 Unosawa ..... 473/316
2005/0272521 A1 * 12/2005 Tsai ..... 473/318

* cited by examiner

*Primary Examiner*—Stephen L. Blau
(74) *Attorney, Agent, or Firm*—Charles F. Rye

(57) ABSTRACT

A one way action golf club flex modification system mounted within a golf club. The non-linear shape of the flex modification member engages the interior wall of the hollow shaft at two regions on opposite sides of the shaft interior and is affixed to a third point in the handle. The "free" end of the flex modification system is closest to the head and generally oriented toward the striking face of the head. The one way action reduces the flexibility of the shaft during the swing toward the golf ball but allows the shaft to flex forward with the travel of the ball. The plane described by the waive shape of the flex member may be fixedly rotated relative to the shaft to allow fine tuning to accommodate the individual swing of the golfer.

4 Claims, 1 Drawing Sheet

DIRECT FLEX

BRIEF SUMMARY OF THE INVENTION

The current invention is installed within a hollow shaft golf club and acts on the shaft without using the shaft as part of its own structure. By design it engages the shaft at three points beginning with the handle and a second point and then a lower region of the shaft on one side only. The club shaft is allowed to flex away from the distal end of the insert but engages the spring action and rigidity of the insert as any force attempts to flex the shaft toward the distal contact point. The forces given major consideration are the inertia of the club shaft end and head as a golfer begins a downward swing toward the ball which tends to bend the shaft and head away from the swing, the forces at impact and the brief time of actual contact with the golf ball. Inserts with differing rigidity and the index able retainer allow customization of the affects of the insert. The insert may be installed in the handle end of the shaft without permanent modification of the shaft. Different materials and conditions of materials which affect modulus of elasticity and variations of profiles of the insert may be implemented in keeping with the three contact point design. Embodiments which give lighter spring action may be shaped to give a preload affect upon insertion into the club shaft to further vary to possible adjustability. Those skilled in the art can envision several arrangements to mount the proximal end of the insert in the open end of the club shaft opposite the head. It would also be apparent to those skilled in the art to provide an indexing means relative to the turning bar or the stop ring to the shaft in order for the user to have a position reference for adjusting the radial position of the tension rod.

The preferred embodiment as shown in the drawings is a tension rod 9 with two bends mounted in a turning bar 7. Turning bar 7 has a central aperture to receive tension rod 9, a turning slot (depression) 12. Stop ring 5 has an outer profile that matches the internal profile of the open end opposite the head of the subject golf club shaft 3. An outer lip 6 helps retain the stop ring at the top of club shaft 3, index marks 10 for a radial position reference to turning bar 7 and inside lip (stop ledge aperture) 8 to help retain turning bar 7 from falling inside club shaft 3. Stop ring 5 is mounted inside club shaft 3's handle end opposite the head by a stop ring securing means and turning bar 7 with tension rod 9 is placed inside it to hold its position as referenced by indicator mark 11 and index marks 10 for adjustment.

DETAILED DESCRIPTION OF THE INVENTION

Figure 1:
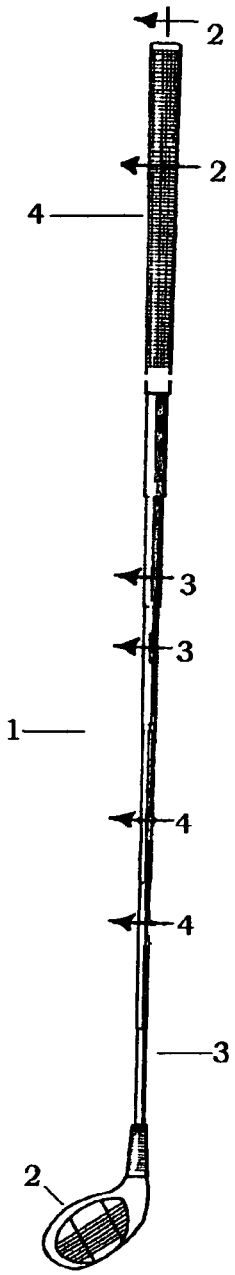
FIG. 1. shows a hollow shaft golf club.

FIG. 1. shows golf club 1 including head 2, shaft 3 and handle 4. Cross sections 2, 3 and 4 are indicated.

Figure 2:
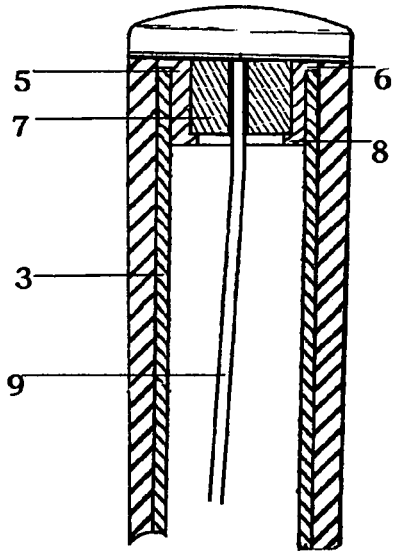
FIG. 2. shows a cross section view of the handle end of the club shaft.

FIG. 2. shows a cross section view of the handle end of golf club 1. Stop ring 5 is mounted inside club shaft 3 and rests on outer lip 6 and engages club shaft 3. Turning bar 7 is installed in stop ring 5 and rests on inside lip 8 and engages stop ring 5. Tension rod 9 is fixedly engaged in the center of turning bar 7 and extends downward in club shaft 3. Stop ring 5 outer lip 6 locates stop ring 5 at the top of club shaft 3.

Figure 3:
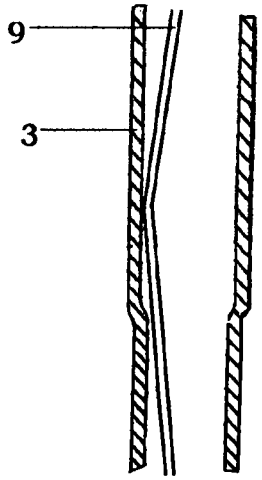
FIG. 3. shows a cross section view of the middle area of the club shaft.

FIG. 3. shows a cross section view of club shaft 3 below handle 4 where tension rod 9 engages shaft 3.

Figure 4:
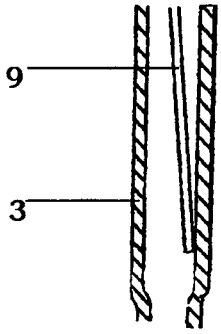
FIG. 4. shows a cross section view of the lower area of the club shaft.

FIG. 4. shows a cross section view of club shaft 3 where the distal end of tension rod 9 engages shaft 3.

Figure 5:
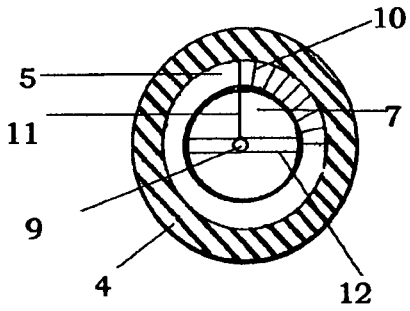
FIG. 5. shows a top view of the handle end of the club shaft.

FIG. 5. shows top view of golf club 1 with stop ring 5 and turning bar 7 installed. Club shaft 3 is obscured by the outer lip 6 of stop ring 5 however club handle 4 is shown. Turning bar 7 is mounted in stop ring 5. tension rod 9 is fixedly mounted in turning bar 7. Stop ring 5 also has index marks 10 used to indicate its position relative to indicator mark 11 on turning bar 7. The top view of tension rod 9 is shown in conjunction with turning slot 12.

Figure 6:
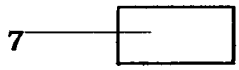
FIG. 6. shows a side view of the turning bar.

FIG. 6. shows a side view of turning bar 7.

Figure 7:
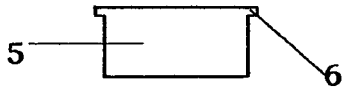
FIG. 7. shows a side view of the stop ring.

FIG. 7. shows a side view of stop ring 5 with external lip 6.

Figure 8:
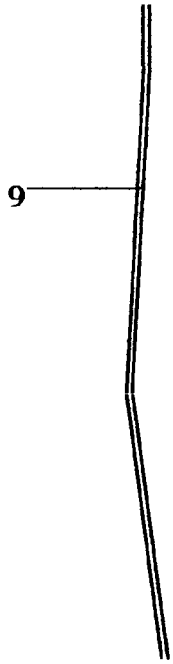
FIG. 8. shows a side view of the tension rod.

FIG. 8. shows tension rod 9 which has a curvealinear shape so that it engages the turning bar in the center of club shaft 3 and two other locations.

The disclosed preferred embodiment is illustrative and not intended to limit those skilled in the art as they can envision alternate embodiments which give equal function.

U.S. Pat. No. 6,241,623 issued to Laibangyang in 2001 discloses a golf club shaft flex modifying system which basically consists of a variable tensioned centrally mounted wire with anchors at each end of the shaft. The apparent novelty of 623 is that it enables the player to readily adjust the tension while playing. Also present are a plurality of wire supports spaced in the shaft to help maintain the wire's centricity during any flexure. Increasing the tension on the central wire tends to exert a compressive force on the shaft section between the anchors thereby modifying the characteristics of the shafts reaction to force exerted by the swing and impact with the golf ball. Again, unlike the present invention 623 modifies the flex characteristics of the shaft at all radial angles and requires a distal anchor that may not be readily removable.

U.S. Pat. No. 6,394,909 also issued to Laibangyang in 2002 discloses a golf club shaft flex modifying system which is very similar to 623. 909 further discloses and claims a tensioned wire and an embodiment includes the central tensioned wire of flat cross section accommodated by the anchor ends. This embodiment further includes wire supports with a slot shaped bore. 623 and 909 both utilize the shaft itself a structural members of the flexure modifying system.

The current invention acts on the shaft without using the shaft as part of its own structure. Due to its generally three contact point shape it engages the lower end of the shaft on one side only. The distal end of the shaft would be allowed to flex away from the insert but engage the rigidity of the insert as any force attempted to flex the shaft toward the distal contact point. The forces given major consideration here are the inertia of the distal end of the shaft and head as a golfer begins a swing which tends to bend the shaft and head away from the swing and the forces at the moment of impact with the golf ball. Inserts with differing rigidity and an index able retainer allow customization of the affects of the insert. The insert may be installed in the proximal handle end of the shaft without modification of the shaft which may be returned to its prior condition.

I claim:

1. A golf club assemble with adjustable shaft flex modifier comprising:

a golf club having an elongated hollow shaft;

said hollow shaft has a head end a length and an opposite handle end which is open;

a tension rod;

said tension rod having a proximal end, length and distal end and being made from material of a predetermined modulus of elasticity over its length and bent at a predetermined angle at a predetermined distance from said distal end;

a turning bar;

said turning bar having a body with a first end and a second end; at least a second end and some portion of said body of said turning bar defining a tension rod aperture adaptive to fixedly receive said tension rod proximal end and some portion of said length of said tension rod, said turning bar body having an outer surface defining a cylinder and said second end of said body of said turning bar defining a depression.

a stop ring;

said stop ring having a body with a first end and a second end; said first end of said body of said stop ring defining an aperture adaptive to rotatably receive said turning bar and said second end of said body of said stop ring defining a stop ledge aperture with is less than the aperture of said first end of said body of said stop ring and said stop ring body having an outer surface defining a profile concomitant to an inner profile of said golf club shaft at said handle end, and said stop ring mounted in said golf club handle end with said stop ring second end toward golf club head, said tension rod proximal end mounted in said turning bar, said tension rod inserted in said golf club shaft distal end first until said turning bar fully engages said stop ring, said turning bar rotated until said tension rod distal end is in a predetermined position relative to said head.

2. The assembly of claim 1 wherein said tension rod modulus of elasticity varies by predetermined values over its length.

3. The assembly of claim 1 wherein said tension rod has at least a partial length of non circular cross section.

4. The assembly of claim 1 wherein said tension rod is a composite material.

* * * * *